US006155379A

United States Patent [19]

Nakagawa

[11] Patent Number: 6,155,379

[45] Date of Patent: Dec. 5, 2000

[54] SILENCING MEMBER FOR MUFFLERS AND METHOD OF MANUFACTURING THE SILENCING MEMBER

[75] Inventor: Yukihiro Nakagawa, Kasugai, Japan

[73] Assignee: NSU Corporation, Kasugai, Japan

[21] Appl. No.: 09/111,852

[22] Filed: Jul. 8, 1998

[51] Int. Cl.[7] ..... F01N 1/24

[52] U.S. Cl. ..... 181/256; 181/222; 181/227; 181/228; 181/252

[58] Field of Search ..... 181/252, 227, 181/228, 258, 211, 212, 213, 214, 217, 222, 256

[56] References Cited

U.S. PATENT DOCUMENTS

| | | | |
|---|---|---|---|
| 2,583,366 | 1/1952 | Engels | 181/42 |
| 2,834,425 | 5/1958 | Rawson | 181/42 |
| 2,909,235 | 10/1959 | Beranek | 181/42 |
| 3,103,987 | 9/1963 | Gildard, III et al. | 181/252 |
| 3,147,097 | 9/1964 | Aguas | 55/276 |
| 3,166,149 | 1/1965 | Hulse et al. | 181/252 |
| 3,175,640 | 3/1965 | Matsui | 181/55 |
| 3,502,171 | 3/1970 | Cowan | 181/252 |
| 3,858,165 | 12/1974 | Pegg | 340/3 R |
| 3,977,492 | 8/1976 | Hankel | 181/252 |
| 4,034,137 | 7/1977 | Hofer | 428/308 |
| 4,077,491 | 3/1978 | Hankel | 181/290 |
| 4,111,081 | 9/1978 | Hilliard et al. | 181/290 |
| 4,421,202 | 12/1983 | Hoy | 181/252 |
| 4,580,656 | 4/1986 | Fukuda | 181/252 |
| 4,667,770 | 5/1987 | DeVane | 181/280 |
| 4,671,841 | 6/1987 | Stephens | 156/292 |
| 5,054,185 | 10/1991 | Usui et al. | 29/455.1 |

FOREIGN PATENT DOCUMENTS

| | | |
|---|---|---|
| 2649979 | 5/1978 | Germany . |
| 563110 | 7/1944 | United Kingdom . |

*Primary Examiner*—Paul Ip
*Assistant Examiner*—Edgardo San Martin
*Attorney, Agent, or Firm*—Wood, Phillips, VanSanten, Clark & Mortimer

[57] ABSTRACT

A silencing member has a plurality of elongate members each having a plurality of elongate glass fibers, with the plurality of elongate members being cross-layered to define a fabric.

16 Claims, 7 Drawing Sheets

SILENCING MEMBER FOR MUFFLERS AND METHOD OF MANUFACTURING THE SILENCING MEMBER

BACKGROUND OF THE INVENTION

1. Field of the Invention

This invention relates to mufflers, as used for example on motor vehicles, and, more particularly, to a silencing member which is incorporated into the mufflers. The invention is also directed to a method of manufacturing the silencing member.

2. Background Art

It is conventional to use a pre-muffler or a sub-muffler on the upstream side of an exhaust system for an internal combustion engine used, for example, in a motor vehicle. Since the pre-muffler/sub-muffler is disposed behind a purging device upstream of a main muffler, high temperature exhaust gas flows at high speed through an exhaust pipe of the pre-muffler/sub-muffler.

A conventional pre-muffler/sub-muffler is shown at 10 in FIG. 18. Stainless wool or stainless wool rope 12 is wrapped around an inner exhaust pipe 14. A multitude of tiny holes 16 are formed through the exhaust pipe 14. Glass wool 18 is wound around the stainless wool/stainless wool rope 12. The glass wool 18 is surrounded by an outer pipe 20. The glass wool 18 functions as a silencing medium. The stainless wool/wool rope 12, which has higher thermal resistance than the glass wool 18, prevents the glass wool 18 from being drawn into the exhaust pipe 14 through the holes 16 and scattering therewithin.

It is also known in the art to use glass cloth with glass fibers made into a plain weave fabric instead of the stainless wool/wool rope 12.

In FIG. 19, a conventional muffler is shown at 22 and has a housing 24 with an end plate 26. Openings 28 are formed through the end plate 26. Long, glass wool fibers 30 are directed through the openings 28 into a space 32 formed between an inner pipe 34, with holes 36 therethrough, and an outer pipe 38 that is part of the housing 24.

The stainless wool/wool rope 12 is relatively expensive and generally its use in this environment requires special processing steps. Scattering of the glass wool 18 within the exhaust pipe 14 is more effectively prevented by increasing the amount of stainless wool/wool rope 12 that is used. By increasing the amount of stainless wool/wool rope 12, the overall cost of manufacture rises.

With the conventional use of glass wool, the glass is woven into a plain weave fabric or a twill weave fabric which has a fine texture and high permeability. The glass captures soot, or the like, entrained in the exhaust gas and eventually becomes clogged. As a result, the silencing effect of the glass wool may be diminished. Further, plain weave and twill weave fabrics, made from glass, may be inefficient and costly to produce.

The manufacturing method described with respect to FIG. 19 reduces costs over the method described with respect to FIG. 18. However, the glass fibers 30 introduced as shown in FIG. 19, may ineffectively fill the space 32. That is, the density of the fibers 30 may be less than desired. Further, there may be an uneven distribution of the fibers 30 within the space 32. If the space 32 is insufficiently filled with the fibers 30, carbon contained in exhaust gas may migrate to within the gaps between the fibers 30 and may adhere thereto. The accumulated and stagnant carbon may diminish the acoustic absorption effect. Further, the accumulated carbon conducts and retains heat, potentially causing the glass fibers 30 to harden, deteriorate, and scatter into the inner pipe 34.

Further, the pressure of the exhaust gas in the inner pipe 34 rises and falls cyclically with the associated internal combustion engine operating. The glass fibers 30 subjected to this varying pressure tend to constantly shift within the housing 24. This movement may cause the glass fibers 30 to break and move through the holes 36 in the inner pipe 34.

SUMMARY OF THE INVENTION

In one form of the invention, a silencing member has a plurality of elongate members each having a plurality of elongate glass fibers, with the plurality of elongate members being cross-layered to define a fabric.

The plurality of elongate members may define one of a tri-axial fabric and a quadri-axial fabric.

The elongate members may be bonded to each other.

In one form, the elongate members cross each other at intersection points and the elongate members are bonded to each other at the intersection points.

The elongate members may be bonded to each other through melted resin. The melted resin may be formed from melted resin fibers. The resin fibers may be acrylic resin fibers.

In one form, the elongate glass fibers have a diameter of at least 24 $\mu$m and more preferably have a diameter of at least 30 $\mu$m. The elongate glass fibers may have a diameter of 30–35 $\mu$m.

In one form, the elongate members are each made from 2,000 to 4,000 elongate glass fibers.

In one form, the fabric has first, second and third layers, with there being a plurality of elongate members in each of the first, second and third layers. The second layer is between the first and third layers and the elongate members in the second layer make an angle of on the order of 60° with the elongate members in each of the first and third layers.

The elongate members may be bulk formed.

The silencing member may be provided in combination with a muffler housing into which the silencing member is incorporated.

The muffler housing may have an exhaust pipe, with the silencing member being wrapped around the exhaust pipe.

The invention is also directed to a method of manufacturing a silencing member, which method includes the steps of forming a plurality of elongate members each having a plurality of elongate glass fibers, and cross-layering the plurality of elongate members to define a fabric.

In one form, the elongate members cross each other at intersection points. The method may further include the step of bonding the elongate members to each other at the intersection points.

The step of cross-layering the plurality of elongate members may involve the step of cross-layering the elongate members using an assembling machine.

The step of bonding the elongate members to each other may involve the step of providing resin fibers at the intersection points and melting the resin fibers at the intersection points.

The method may further include the step of needle processing the fabric to bulk form the fabric.

The step of cross-layering the plurality of elongate members may involve the step of cross-layering the plurality of elongate fibers to form fabric that is one of tri-axial and quadri-axial.

The elongate members may be bulk formed.

The invention further contemplates a method of forming a muffler, which method involves the steps of providing a muffler housing, providing a silencing member by forming a plurality of elongate members each having a plurality of elongate fibers, and cross-layering the plurality of elongate members to define a fabric, and incorporating the fabric into the muffler housing.

The muffler housing may have an exhaust pipe. The step of incorporating the fabric into the muffler housing may involve the step of wrapping the fabric around the exhaust pipe.

DETAILED DESCRIPTION OF THE DRAWINGS

Figure 1:
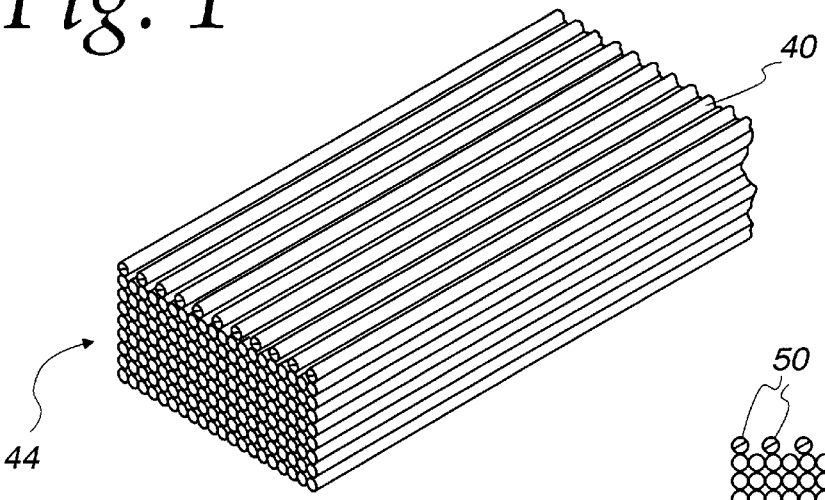
FIG. 1 is a fragmentary, schematic, perspective view of an elongate member used to form a silencing member, according to the present invention.
Figure 2:
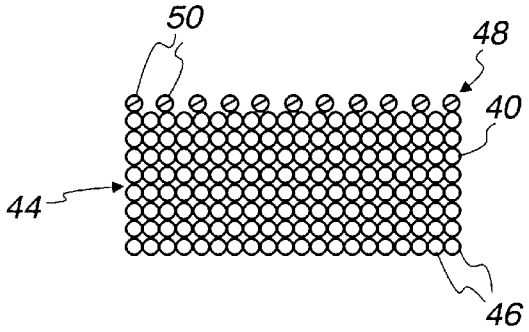
FIG. 2 is an enlarged, schematic cross-sectional view of the elongate member in FIG. 1.
Figure 3:
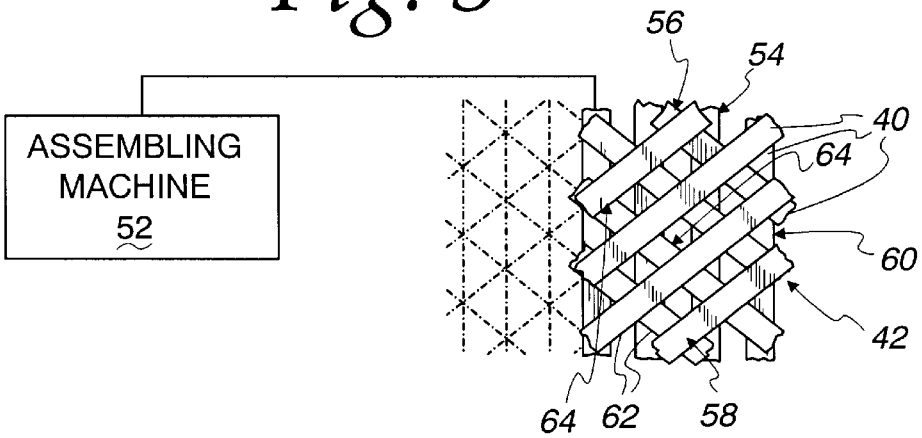
FIG. 3 is a reduced, fragmentary, schematic, plan view of a silencing member made from a plurality of the elongate members, as in FIGS. 1 and 2, formed into a tri-axial fabric.
Figure 4:
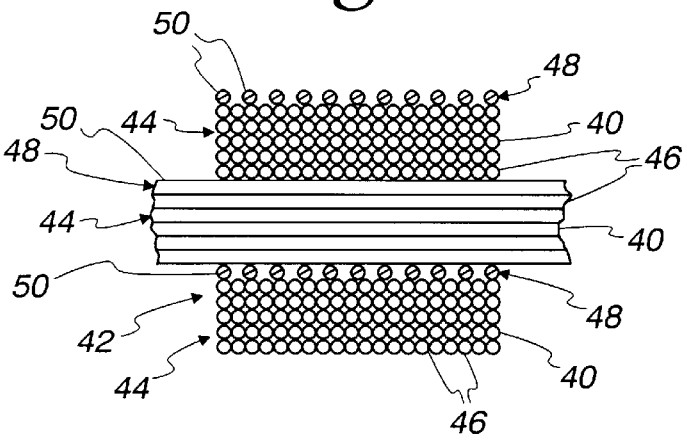
FIG. 4 is an enlarged, schematic, cross-sectional view of the silencing member in FIG. 3.
Figure 5:
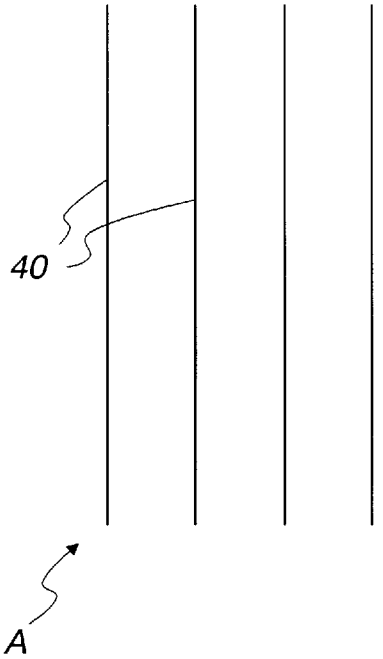
FIG. 5 is a schematic representation of one layer used to form the tri-axial fabric in FIG. 3.
Figure 6:
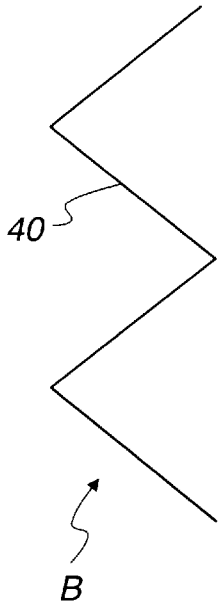
FIG. 6 is a schematic representation of a second layer used to form the tri-axial fabric in FIG. 3.
Figure 7:
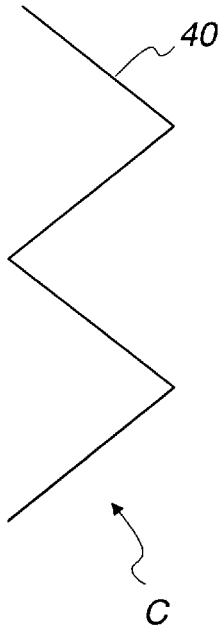
FIG. 7 is a schematic representation of a third layer used to form the tri-axial fabric in FIG. 3.
Figure 8:
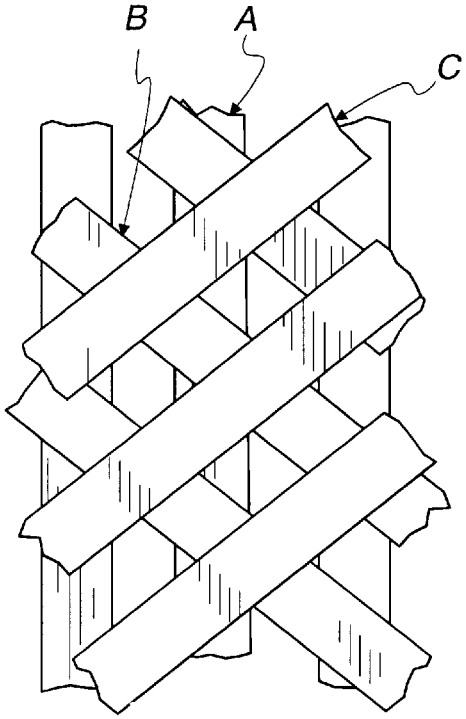
FIG. 8 is a fragmentary, plan view of a silencing member made from a tri-axial fabric, according to the present invention.

In FIGS. 1–4, elongate members 40 are shown arranged to define a silencing member 42, according to the present invention. The elongate members 40 are shown schematically for purposes of illustration.

Each elongate member 40 has a glass layer 44 made up of closely concentrated, bundled, elongate glass fibers 46. A resin layer 48, made up of a plurality of resin fibers 50, is formed on one side of the glass layer 44.

The glass fibers 46 have a diameter that is larger than that of most conventional glass fibers used in this type of environment, to increase heat resistance. Generally, conventional glass fibers are made with a maximum diameter of 24 $\mu$m. The glass fibers 46 preferably have a diameter of greater than 24 $\mu$m. In a preferred form, the diameter of the glass fibers 46 is in the range of 30–35 $\mu$m. It should be understood, however, that the invention can be practiced with glass fibers 46 having a diameter less than 24 $\mu$m.

The glass layer 44 is preferably defined by a neatly arranged, compact stack of 2,000–4,000 pieces of elongate glass fiber 46.

The resin fibers 50 in the resin layer 48 are preferably made of hot melt fiber, such as acrylic resin fiber. The diameter of the resin fibers 50, and the concentration thereof, are selected so that the elongate members 40 effectively adhere, one to the other, as hereafter described.

The elongate members 40 are combined to form the silencing member 42 using an assembling machine 52, as is conventionally used for manufacturing fabrics. Through the machine 52, a first layer 54 of parallel, elongate members 40 is formed. A second layer 56 of parallel, elongate members 40 is applied over the first layer 54 so that the lengths of the elongate members 40 in the second layer 56 are diagonal to the lengths of the elongate members 40 in the first layer 54. In turn, a third layer 58, consisting of parallel, elongate members 40, is provided over the second layer 56 so that the lengths of the elongate members 40 in the third layer 58 are diagonal to the lengths of the elongate members 40 in the first layer 54, but oppositely diagonal to the lengths of the elongate members 40 in the second layer 56. The elongate members 40 in the first, second and third layers 54, 56, 58 extend in three different directions and form an angle on the order of 60° with respect to one another. The fabric 60 that results from this process is a tri-axial fabric with lattice gaps 62 each having the shape of an equilateral triangle. The lattice gaps 62 function as vent holes through the silencing member 42.

The cross-layered elongate members 40 cross and engage each other at intersection points 64. The elongate members 40 are bonded to each other at the intersection points 64 by melting the resin fibers 50 thereat. By heating the fabric 60 to a temperature sufficient to melt the resin fibers 50, bonding is effected. This melting can be accomplishing by using heating rollers, or other structure known to those skilled in this art.

In FIGS. 5–8, one method of manufacturing the tri-axial fabric 60 is shown. The method involves longitudinally arranging a multitude of elongate members 40 in a first layer A, placing on the layer A elongate members 40 in a zig-zag pattern, shown as a second layer B in FIG. 6, and thereafter placing on the layer B a further layer of elongate members 40 in a zig-zag pattern, shown as a third layer at C in FIG. 7, and effecting bonding at intersection points, as previously described.

Conventional plain weave fabric, or the like, generally has a two axis arrangement. Thus, generally, the fabric 60 in the silencing member 42 surpasses plain weave fabric, or the like, in isotropy, bursting strength, tear strength, shear strength, and impact strength. Further, the fabric 60 can potentially be produced much faster than plain weave fabric. In testing, the fabric 60 has been produced approximately ten times as fast as plain weave fabric.

Figure 9:
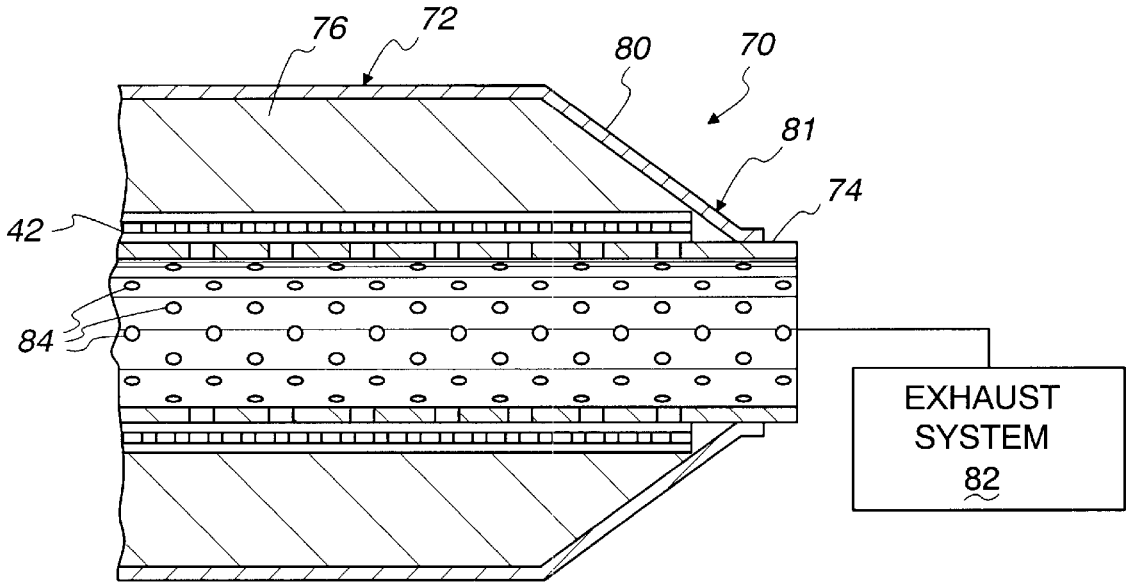
FIG. 9 is a fragmentary, cross-sectional view of a muffler incorporating a silencing member, according to the present invention.

Referring to FIG. 9, a muffler 70 is shown with the silencing member 42 incorporated therein. The muffler 70 has a housing 72 including an inner exhaust pipe 74 around which the silencing member 42 is wrapped. Glass wool in the form of a glass needle mat 76 is then wound around the silencing member 42 and surrounded by an outer pipe 80 on the housing 72. The ends 81 (one shown) of the outer pipe 80 are constricted to closely conform to the exhaust pipe 74 and welded thereto in conventional manner.

The operation of the muffler 70 will now be described. If exhaust noise is generated in the exhaust pipe 74 connected with an exhaust system 82, the exhaust noise is transmitted to the silencing member 42 and the glass wool 76 through holes 84 in the exhaust pipe 74. The sound attenuation is effected primarily by the glass wool 76. The silencing member 42 also contributes to the elimination of exhaust noise. It has been found that the silencing member 42 is better than conventional stainless wool, stainless rope, and glass cloth in its silencing capabilities.

The exhaust gas flowing inside the exhaust pipe 74 generates negative pressure around the holes 84. The glass wool 76 is thus urged inwardly towards the holes 84. However, by densely bundling the glass fibers 46 in the glass layer 44, and reducing the area of the lattice gaps 62, it is possible to prevent the glass wool 76 from being sucked into the exhaust pipe 74 through the holes 84 and scattering within the exhaust pipe 74. With the glass fibers 46 having a diameter of no less than 24 $\mu$m, the fibers 46 exhibit good strength and prevent the glass wool 76 from scattering.

Further, the elongate members 40, within which the glass fibers 46 are bundled, are fixedly arranged in the tri-axial fabric 60. Once the elongate members 40 have been incorporated into the muffler 70 by wrapping around the exhaust pipe 74, the regular compacted arrangement of glass fibers 46 is substantially maintained. As a result, the lattice gaps 62 do not appreciably enlarge. Thus, it is possible to reliably prevent the glass wool 76 from being sucked through the holes 84 and scattering within the exhaust pipe 74.

Figure 10:
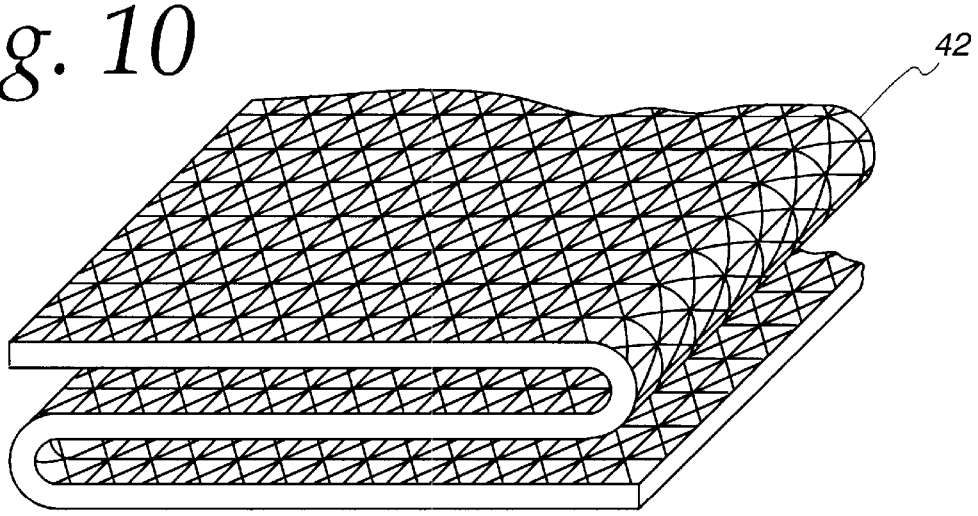
FIG. 10 is a fragmentary, perspective view of a silencing member, according to the present invention, in a folded state.

In FIG. 10, the silencing member 42 is made into a structure having multiple layers, in this case, three layers. To accomplish this, the silencing member 42 may be folded against itself. Alternatively, two or three pieces of the silencing material 42 may be continuously wound around the exhaust pipe 74, as shown in FIG. 9.

With the multiple layer arrangement in FIG. 10, the sound attenuating effect may be enhanced. Even in the event that the lattice gaps 62 are fairly large, each gap 62 faces an overlying/underlying layer of the silencing member 42. This effectively prevents the glass wool 76 from migrating through the lattice gaps 62.

Figure 11:
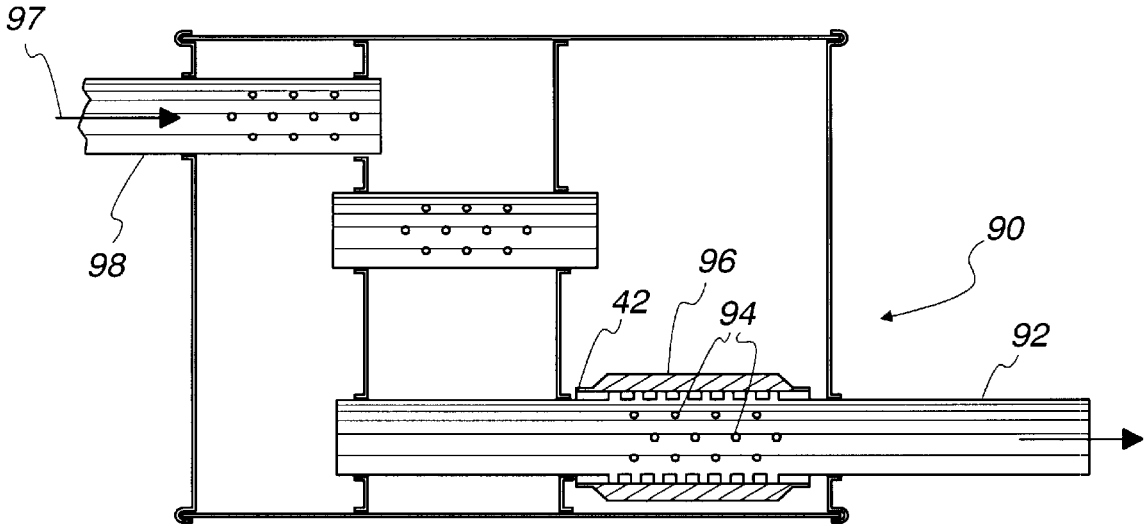
FIG. 11 is a cross-sectional view of a main muffler having a silencing member, according to the present invention, incorporated therein.
Figure 12:
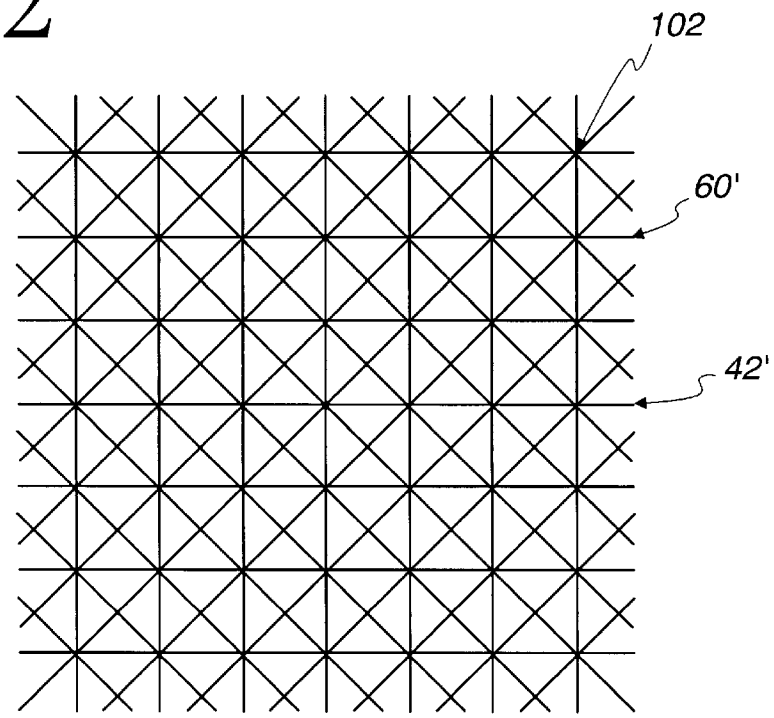
FIG. 12 is a schematic, plan view of a silencing member, according to the present invention, and formed from a quadri-axial fabric.
Figure 13:
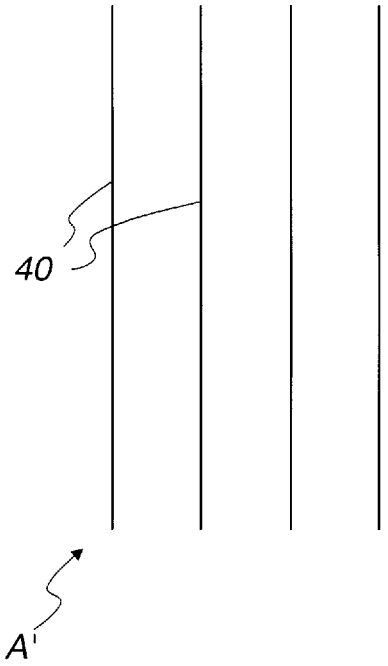
FIGS. 13–15 are schematic representations of layers of elongate members used to form the quadri-axial fabric of FIG. 12.
Figure 14:
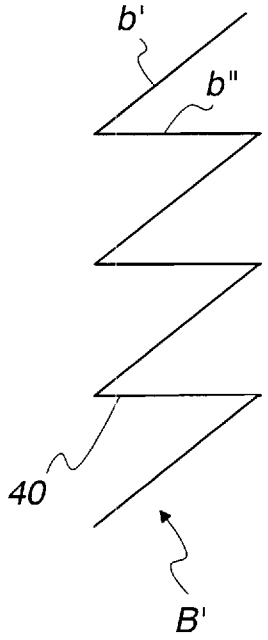
Figure 15:
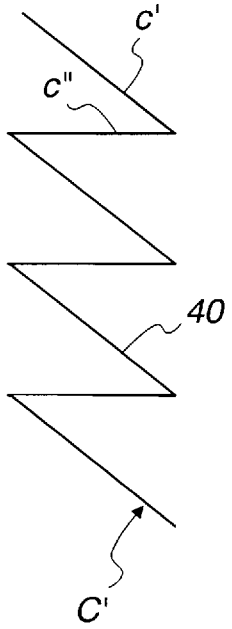

FIG. 11 illustrates the silencing member 42 incorporated into a main muffler 90. An outlet pipe 92 has holes 94 therethrough. The silencing member 42 is wrapped around the pipe 92 and over the holes 94. The silencing member 42 is in turn surrounded by an outer pipe 96. Exhaust gas is introduced in the direction of the arrow 97 to an inlet pipe 98.

In this embodiment, the glass wool 76, used in the embodiment in FIG. 9, is eliminated. The silencing member 42 is wrapped to form a plurality of layers around the outlet pipe 92. The silencing member 42 in the multi-thickness arrangement effectively eliminates exhaust noise.

In FIGS. 12–15, a silencing member 42' is shown made from a quadri-axial fabric 60'. The elongate members 40 defining the silencing member 42' are shown schematically as lines through the central axes of the elongate members 40.

To construct the fabric 60', a first layer A' of elongate members 40 is formed with the elongate members 40 therein spaced and parallel to each other. Elongate members 40 in a layer B' are placed over the elongate members 40 in the layer A' such that elongate members b' extend diagonally to the elongate members 40 in the layer A'. Elongate members 40 in a layer C' are placed over the elongate members 40 in the layer B' such that elongate members c' extend in a direction diagonally to the elongate members 40 in the layer A' but oppositely to the elongate members b'. Elongate members b", c" in the layers B', C' extend generally orthogonally to the elongate members 40 in the layer A'.

More specifically, after the elongate members 40 in the layer A' are arranged, a plurality of elongate members 40 in the shape of a "Z" in the layer B' are placed over the elongate members 40 in the layer A'. A plurality of elongate members 40 in the shape of a "Z", that is reversed to the "Z" of the elongate members 40" in the layer B', are placed over the layer B'. Laterally extending elongate members c" in the layer C' are offset relative to laterally extending elongate members b" in the layer B'. The intersection points 102 are bonded, as previously described. The quadri-axial fabric 60' functions similarly in operation to the tri-axial fabric 60.

It is possible with all embodiments herein to eliminate the resin fiber layer 48. Glue may be applied in the region of the intersection points 64, 102 to effect adherence between the elongate members 40.

Figure 16:
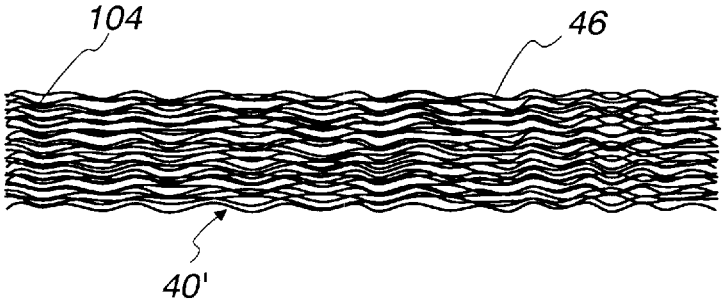
FIG. 16 is an enlarged, fragmentary, cross-sectional view of a bulk formed, elongate member, according to the present invention.

The invention also contemplates a modified form of construction for the elongate members, as shown at 40' in FIG. 16. Each of the glass fibers 46 may be bent to a wavy shape so as to increase the bulk of the elongate members 40'. Many glass fibers 46, from hundreds to thousands in number, can be neatly arranged and stacked in concentrated fashion.

The elongate members 40', as in the prior embodiments, are cross-layered, as by using an assembling machine, with the intersection points bonded to form a fabric. The elongate members 40' can be arranged to form a tri-axial or quadri-axial fabric. The elongate members 40' may be bonded either through use of an adhesive/glue or by incorporating resin fiber layers on one side of the accumulated glass fibers 46. The intersection points can be heated to melt the resin fiber.

By bulk forming the elongate members 40', a number of gaps 104 are formed amongst the glass fibers 46. The fabric formed therefrom thus effectively absorbs exhaust noise, such as that resulting from the exhaust gas flow into the exhaust pipe inlet 98 and from the exhaust outlet 92 (see FIG. 11), thereby converting acoustic energy into thermal energy. This adds a further enhancement to the sound attenuation capability, compared with the aforementioned fabrics 60, 60' which do not have bulk formed elongate members 40'.

Figure 17:
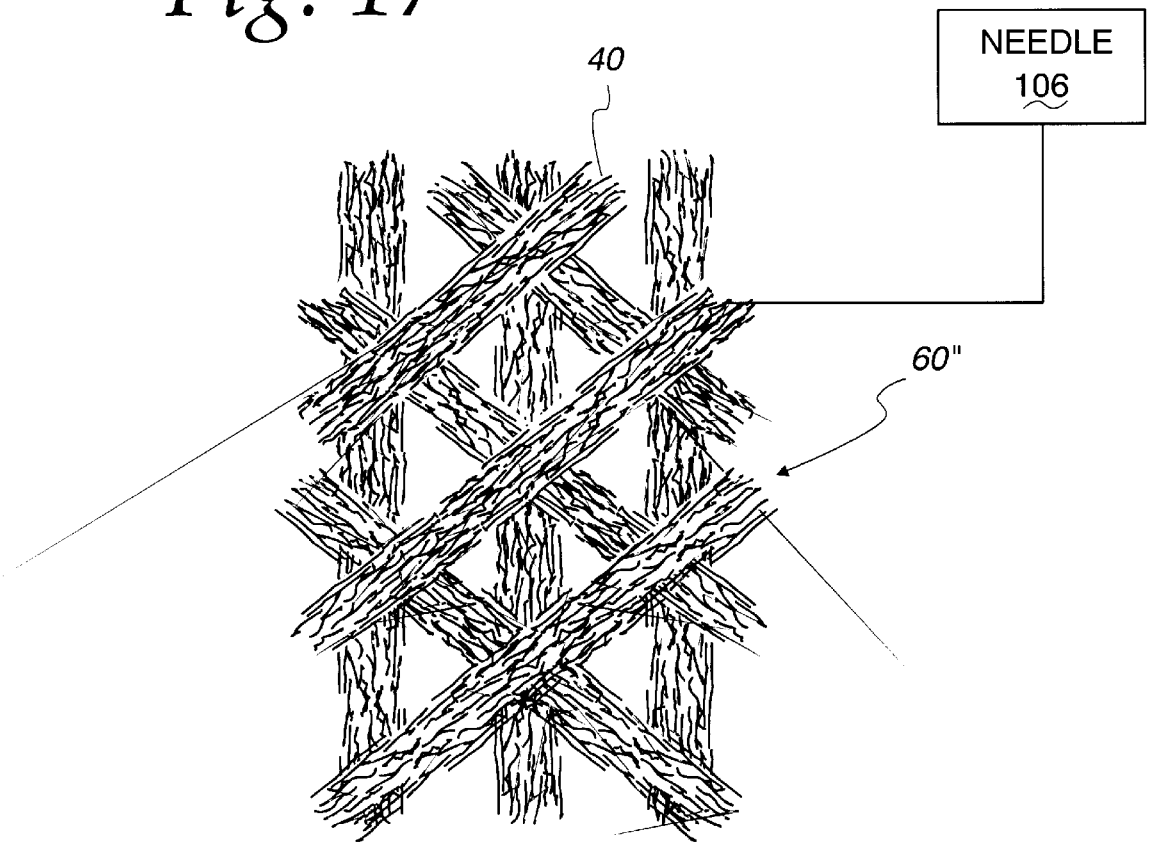
FIG. 17 is a fragmentary, plan view of the silencing member made from a tri-axial fabric that is bulk formed.
Figure 18:
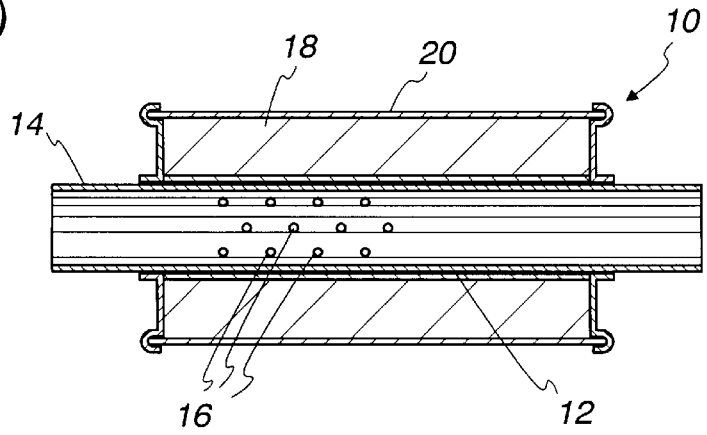
Fig. 18 (Prior Art)
FIG. 18 is a cross-sectional view of a muffler having conventional silencing structure incorporated therein.
Figure 19:
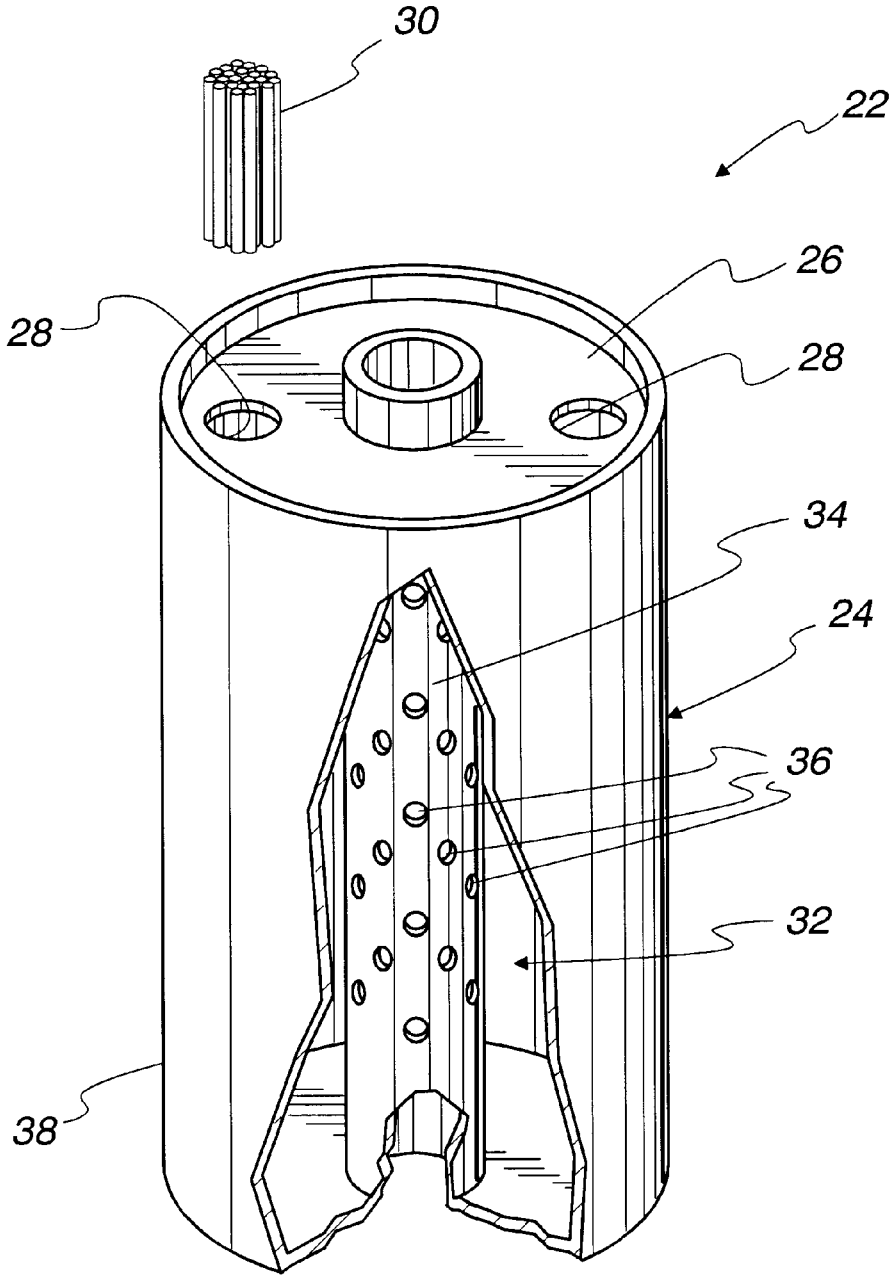
Fig. 19 (Prior Art)
FIG. 19 is a perspective view of a muffler and showing another conventional silencing structure incorporated therein.

In FIG. 17 a further aspect of the present invention is shown. A fabric 60" is shown made from elongate members 40 to be in either tri-axial or quadri-axial form. No resin layer is formed on the elongate members. Thereafter, the fabric 60" undergoes a needle processing step in which the fabric 60" is pierced with a needle 106 as used for producing glass needle mats. The needle processing causes the elongate members 40 to be bulk formed, thereby enhancing sound absorption.

The foregoing disclosure of specific embodiments is intended to be illustrative of the broad concepts comprehended by the invention.

What is claimed is:

1. A silencing member comprising:

a plurality of elongate members each comprising a plurality of elongate glass fibers, said plurality of elongate members being cross-layered to define a fabric with oppositely facing sides; and a resin layer comprising resin fibers formed on one of the oppositely facing sides.

2. The silencing member according to claim 1 wherein the plurality of elongate members define one of a tri-axial fabric and a quadri-axial fabric.

3. The silencing member according to claim 1 wherein the elongate members are bonded to each other through the resin fibers.

4. The silencing member according to claim 3 wherein the elongate members cross each other at intersection points and the elongate members are bonded to each other at the intersection points.

5. The silencing member according to claim 3 wherein the elongate members are bonded to each other by melting of the resin fibers.

6. The silencing member according to claim 1 wherein the elongate glass fibers have a diameter of at least 24 $\mu$m.

7. The silencing member according to claim 6 wherein the elongate glass fibers have a diameter of at least 30 $\mu$m.

8. The silencing member according to claim 7 wherein the elongate glass fibers have a diameter of 30–35 $\mu$m.

9. A silencing member comprising:

a plurality of elongate members each comprising a plurality of elongate glass fibers, said plurality of elongate members being cross-layered to define a fabric, wherein the elongate members each comprise 2000–4000 elongate glass fibers.

10. The silencing member according to claim 1 wherein the resin fibers comprise acrylic resin fibers.

11. A silencing member comprising:

a plurality of elongate members each comprising a plurality of elongate glass fibers, said plurality of elongate members being cross-layered to define a fabric, wherein the fabric comprises first, second and third layers, there are a plurality of elongate members in each of the first, second and third layers, the second layer is between the first and third layers, and the elongate members in the second layer make an angle of on the order of 60° with the elongate members in each of the first and third layers.

12. The silencing member according to claim 1 wherein the elongate members are bulk formed.

13. The combination according to claim 12 wherein the muffler housing comprises an exhaust pipe and the silencing member is wrapped around the exhaust pipe.

14. In combination:

a) a silencing member comprising:

a plurality of elongate members each comprising a plurality of elongate glass fibers, said plurality of elongate members being cross-layered to define a fabric with oppositely facing sides; and a resin layer comprising resin fibers formed on one of the oppositely facing sides; and b) a muffler housing into which the silencing member is incorporated.

15. A silencing member comprising:

a plurality of elongate members each having a length and comprising a plurality of elongate glass fibers, a first plurality of the elongate members being arranged in parallel and in spaced relationship to define a first layer, there being no interconnection of the first plurality of elongate members over a first substantial area of the first layer, a second plurality of the elongate members being arranged in parallel and spaced relationship to define a second layer, the first and second layers being formed one against the other with the lengths of the elongate member in the first and second layers being transverse to each other, a third plurality of the elongate members is arranged in parallel and spaced relationship to define a third layer that is formed directly against one of the first and second layers so that one of the first, second, and third layers resides between the other two of the first, second, and third layers, the one layer being non-orthogonal to the other two of the first, second, and third layers, wherein the elongate members on the first second, and third layers are not interwoven and are bonded to each other over the first substantial area.

16. The silencing member according to claim 15 wherein the second plurality of elongate members are not interconnected to each other over a second substantial area over-/underlying the first substantial area.

* * * * *